US005257918A

United States Patent [19]

Kraemer

[11] Patent Number: 5,257,918

[45] Date of Patent: Nov. 2, 1993

[54] FUEL INJECTION PUMP WITH A CONICAL TRANSITION OUTLET AREA

[75] Inventor: Manfred Kraemer, Schwieberdingen, Fed. Rep. of Germany

[73] Assignee: Robert Bosch GmbH, Stuttgart, Fed. Rep. of Germany

[21] Appl. No.: 973,863

[22] Filed: Nov. 9, 1992

[30] Foreign Application Priority Data

Nov. 8, 1991 [DE] Fed. Rep. of Germany ..... 4136756

[51] Int. Cl.[5] ..... F04B 21/02

[52] U.S. Cl. ..... 417/569; 417/570; 251/337; 137/543.23

[58] Field of Search ..... 417/570, 567, 569; 251/337; 137/540, 543.23

[56] References Cited

U.S. PATENT DOCUMENTS

| | | | |
|---|---|---|---|
| 1,590,766 | 6/1926 | Lipman | 417/570 |
| 4,127,366 | 11/1978 | Sumi . | |
| 4,403,628 | 9/1983 | Nijjar | 137/540 |
| 4,665,943 | 5/1987 | Medvick et al. | 251/337 |
| 5,033,506 | 7/1991 | Bofinger | 137/543.23 |

FOREIGN PATENT DOCUMENTS

| | | | |
|---|---|---|---|
| 875757 | 10/1941 | France | 417/569 |
| 508406 | 6/1939 | United Kingdom | 417/569 |
| 513349 | 10/1939 | United Kingdom | 417/569 |

*Primary Examiner*—Richard A. Bertsch
*Assistant Examiner*—Roland McAndrews
*Attorney, Agent, or Firm*—Edwin E. Greigg; Ronald E. Greigg

[57] ABSTRACT

The invention provides a fuel injection pump for internal combustion engines having a high-pressure chamber, which is intermittently brought to high fuel pressure, and which communicates via a pressure line with an injection point of an engine, and having a pressure valve, inserted into the pressure line. This pressure valve comprises a valve body and a valve seat onto which a valve member is pressed by the force of a valve spring. The valve spring is located in a recess of a pressure valve holder, which communicates with the injection line via an axial conduit. A transitional region leading from the diameter of the axial recess to the diameter of the conduit is embodied with a cone shape or a truncated cone shape.

4 Claims, 2 Drawing Sheets

FUEL INJECTION PUMP WITH A CONICAL TRANSITION OUTLET AREA

BACKGROUND OF THE INVENTION

The invention is directed to improvements in fuel injection pumps.

One such pump is known from U.S. Pat. No. 4,127,366. In that fuel injection pump, fuel is pumped via a pressure valve into a conduit of a pressure valve holder by a pump piston driven to reciprocate in a cylinder bore; in the cylinder bore, this piston encloses a pump work chamber, and the piston is rotatable about its axis for fuel quantity distribution. The pressure valve holder connects the pump element, which receives the pump cylinder and the pump piston, to the injection line, which in turn connects the injection pump and injection nozzle with one another. A pressure valve spring disposed in an axial recess in the pressure valve holder and closing the pressure valve in the direction of the pump work chamber is supported on a support part that rests on the end face of the axial recess into which the conduit to the injection line discharges. In the known fuel injection pump, the support part is a circular-cylindrical disk, from which an axial protrusion serving to guide the valve spring projects. The face end of the recess is adapted to the cylindrical shape of the support part and thus has an abrupt transition from the large diameter of the recess to the smaller diameter of the conduit. As the demands for injection pressure increase, increasing loads on material arise because of the incident high injection pressures of up to 1300 bar. These pressures arise especially in the high-pressure regions, that is, in the pump work chamber and the parts through which fuel flows at high pressure. Hence the fuel flows at high pressure via the opened pressure valve through the recess of the pressure valve holder and in so doing exerts a high pressure upon the inner wall of the housing. With the increasing load via the injection pressure upon successive working strokes of the pump piston, peaks of tension occur at the sudden change in diameter because of a notching effect that causes fissuring, which in turn causes breaks and the resultant disruptions to fuel injection pump function.

OBJECT AND SUMMARY OF THE INVENTION

It is a principal object of the fuel injection pump according to the invention to provide the advantage over the prior art that as a result of a steady change in the inside diameter, in the form of a cone, on the face end of the recess that receives the conduit mouth, a uniform distribution of tension is achieved. With the attendant reduction in tension peaks, fissures and hence permanent breakage can be avoided even without reinforcing the material. To keep the idle volume, resulting from the altered shape of the interior of the pressure valve holder, as small and constant as possible, a support card is advantageously used that here additionally has the function of a filler part and moreover forms a secure spring support.

It is another object of the invention to provide that when a support part is used with a conical course of the jacket face that does not discharge into the diameter of the conduit but rather into a larger diameter, it is advantageous to round off the resultant corners on the pressure valve holder and support part, thus avoiding the notching effects that arise at that point.

The invention will be better understood and further objects and advantages thereof will become more apparent from the ensuing detailed description of preferred embodiments taken in conjunction with the drawings.

All the views are shown in longitudinal section; the illustration has concentrated on the pressure valve holder according to the invention, which in turn is a component of a known fuel injection pump.

DESCRIPTION OF THE PREFERRED EMBODIMENTS

Figure 1:
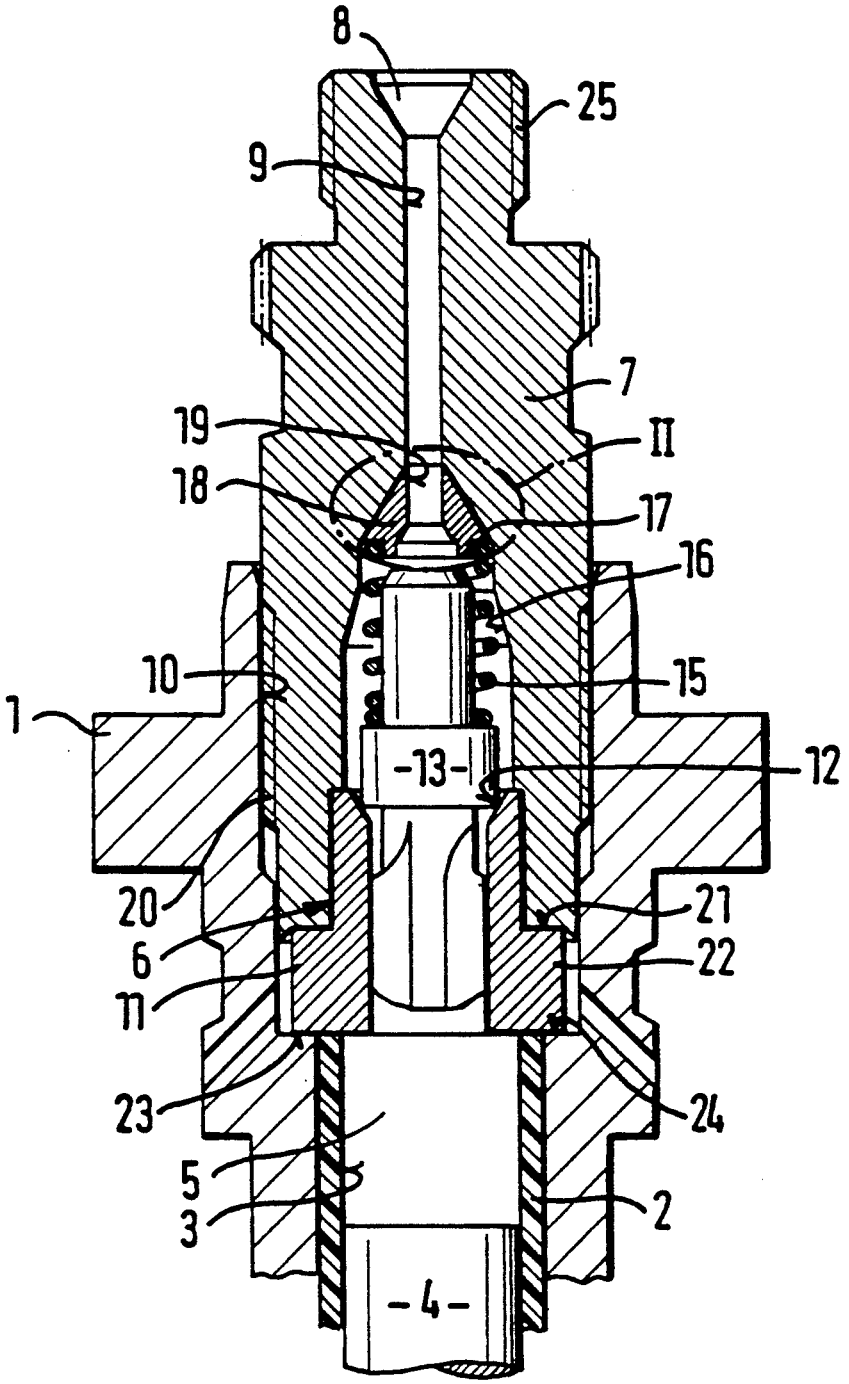
FIG. 1 is a detail of a fuel injection pump that shows the installed location of the subject of the invention.

FIG. 1 shows a detail of a fuel injection pump, not otherwise shown, having a pump cylinder 2 inserted into a pump housing 1, in the cylinder bore 3 of which cylinder a pump piston 4 defines a pump work chamber 5; the pump piston 4 is made to axially reciprocate by a camshaft, not shown, and is rotatable to adjust the fuel supply quantity. The pump work chamber 5 communicates with an injection line, also not shown, via a pressure valve holder 7 that receives a pressure valve 6 and via an axial conduit 9 disposed in the interior of the pressure valve holder 7 and discharging into a connection piece 8; the injection line in turn connects the fuel injection pump to an injection location of the engine.

In the axial extension of the pump work chamber 5, the pressure valve 6 is inserted into a bore 10 of the pump housing 1, and it comprises a valve body 11, further defining the pump work chamber 5 and having a valve seat 12 onto which a valve member 13 is pressed by the force of a valve spring 15. The valve spring 15, in turn, is located in an axial recess 16 of the pressure valve holder 7 and is supported there on a support part 18 forming an inner end wall 17 of the recess 16; the support part has an axial bore 19 having the same diameter as the axial conduit 9. Via a first male thread 20, the pressure valve holder 7 is screwed into the bore 10 of the pump housing 1, and with its face end 21 surrounding the recess 16, it keeps the valve body 11 pressed, by its end face 23 toward the pump work chamber 5, against a shoulder 24 of the pump housing 1 via a collar 22 on its circumference. A second male thread 25 on the part of the pressure valve holder 7 protruding from the pump housing serves to secure the injection line.

Figure 2:
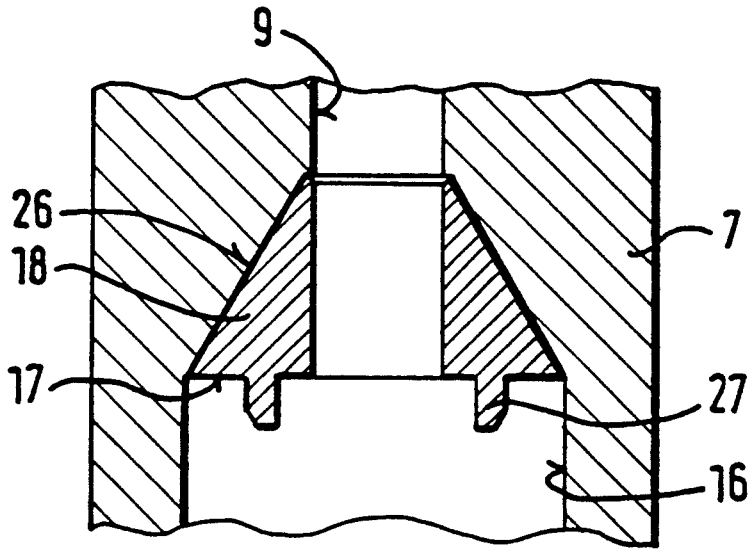
FIG. 2, in a detail of FIG. 1, shows a first exemplary embodiment of the pressure valve holder according to the invention.
Figure 3:
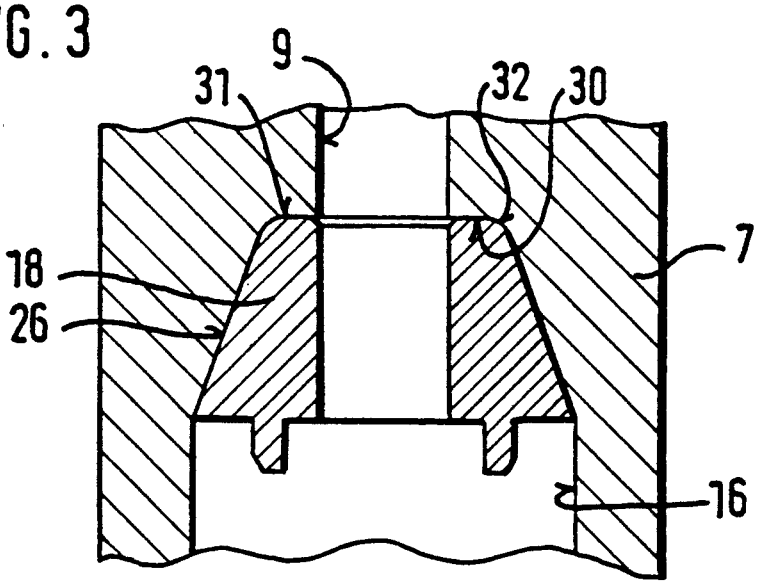
FIG. 3, in a view similar to that of FIG. 2, shows a second exemplary embodiment, in which the conical tapering of the inside diameter of the recess discharges into a shoulder.

For the sake of greater clarity, FIGS. 2 and 3 show a detail of the part of the fuel injection pump that has the pressure valve holder 7 according to the invention, on a larger scale.

In the first exemplary embodiment shown in FIG. 2, the diameter of the axial recess 16 tapers uniformly to the diameter of the axial conduit 9, forming a conical transitional face 26 from the axial recess 16 to the conduit 9. The support part 18 acting as a filler part is inserted into this thus-created transitional face 26, in order to attain the flat end wall 17 serving as a spring support face and to attain a decrease in the resultant additional idle volume. By means of this cross-sectional transition 26 according to the invention, it is possible to attain a homogeneous distribution of the pressure of the support part 18, which is acted upon by the high fuel pressure, to the pressure valve holder, and thus to avoid notching effects at the pressure valve holder 7. To assure an unhindered flow of fuel when the valve member 13 is opened, two diametrically opposed circular ring segments, which form two stops 27 for the valve member 13, are also disposed on the inside end wall 17 of the support part 18.

Analogously to the first exemplary embodiment, the second exemplary embodiment shown in FIG. 3 shows a further embodiment of the transitional face 26 from the diameter of the axial recess 16 to the diameter of the conduit 9. Here, the conical transitional face 26 from the diameter of the recess 16 does not reach as far as the diameter of the conduit 9 but rather ends at a shoulder 30, so that on the side of the transitional face 26 remote from the pump work chamber 5, a top face 31 is created, and the edges between the transitional face 26 and the top face 31 are embodied as a radius 32. This gives the support part 18 disposed in the transitional face 26 the shape of a truncated cone. That configuration has the advantage that the support part 18, pressed against the pressure valve holder 7 by the valve spring 15 and by the supply pressure of the fuel, is securely guided, and a possible notching effect at the edges of the top face 31 is avoided by their embodiment as a radius 32.

The fuel injection pump according to the invention functions as follows:

In operation of the engine supplied by the fuel injection pump, the fuel that has reached the pump work chamber 5 via inflow lines, not shown, is compressed by the pump piston 4 during the supply stroke. In the process, the fuel, which is at high pressure, lifts the valve member 13 away from the valve seat 12 of the valve body 11, counter to the force of the valve spring 15, and the fuel flows along the valve member 13 through the bore 19 of the support part 18, through the axial conduit 9 in the pressure valve holder 7, and through the injection line to reach the injection point of the engine. As a result of the course according to the invention of the transitional face 26 from the diameter of the recess 16 to the diameter of the axial conduit 9 in the pressure valve holder 7, the support part 18 transmits the pressure of the fuel, which is at high pressure to the pressure valve holder 7, uniformly and without peaks of tension, so that notching effects can be avoided. In this way, it is possible even without reinforcement of the material, and even in intermittent high-pressure production, to avoid permanent breakage in the pressure valve holder 7 of the fuel injection pump and thus to attain a long service life of the overall fuel injection pump.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a high-pressure chamber (5), which is intermittently brought to high fuel pressure, and which communicates via a pressure line with an injection point of an engine, and further having a pressure valve (6) inserted into the pressure line and comprising a valve body (11) and a valve seat (12) onto which a valve member (13) is pressed by the force of a valve spring (15), the valve spring being disposed in an axial recess (16) provided in a pressure valve holder (7) and supported there on a support part (18) disposed on an end wall (17) of the recess (16), said pressure valve holder having an axial conduit (9) which passes through the support part (18) into the axial recess (16), said axial conduit is of constant diameter and communicates via a connection piece (8) of the pressure valve holder (7) with the pressure line, the pressure valve holder being screwed into the housing (1) of the fuel injection pump with its face end (21) surrounding the axial recess (16) to keep the valve body (11) pressed against a shoulder (24) defined in the housing (1), a transitional region defined in that portion of the axial recess (16) of the pressure valve holder (7) adjacent to the conduit end (9) having a substantially conical configuration, into which region a correspondingly shaped support part (18) is inserted, in which the support part (18) has a smaller top face (31) on its extremity remote from the pressure valve (6), said top face being equal in size to the cross-section of the conduit (9).

2. A fuel injection pump for internal combustion engines having a high-pressure chamber (5), which is intermittently brought to high fuel pressure, and which communicates via a pressure line with an injection point of an engine, and further having a pressure valve (6) inserted into the pressure line and comprising a valve body (11) and a valve seat (12) onto which a valve member (13) is pressed by the force of a valve spring (15), the valve spring being disposed in an axial recess (16) provided in a pressure valve holder (7) and supported there on a support part (18) disposed on an end wall (17) of the recess (16), said pressure valve holder having an axial conduit (9) which passes through the support part (18) into the axial recess (16), said axial conduit is of constant diameter and communicates via a connection piece (8) of the pressure valve holder (7) with the pressure line, the pressure valve holder being screwed into the housing (1) of the fuel injection pump with its face end (21) surrounding the axial recess (16) to keep the valve body (11) pressed against a shoulder (24) defined in the housing (1), a transitional region defined in that portion of the axial recess (16) of the pressure valve holder (7) adjacent to the conduit end (9) having a substantially conical configuration, into which a correspondingly shaped support part (18) is inserted, in which the support part (18) has a smaller top face (31) on its extremity remote from the pressure valve (6), said top face being larger than the cross-section of the conduit (9).

3. A fuel injection pump as defined by claim 2, in which the transitional region defines a conical jacket face portion (26) on the support part (18) which merges to the top face (31) of the support part (18) in a rounded peripheral edge (32).

4. A fuel injection pump as defined by claim 2, in which the support part (18) has a configuration like a truncated cone with a smoothly rounded edge of truncation.

* * * * *